US006939178B2

(12) United States Patent
Arcykiewicz et al.

(10) Patent No.: US 6,939,178 B2
(45) Date of Patent: Sep. 6, 2005

(54) FUEL INJECTOR CONNECTOR

(75) Inventors: Robert Raymond Arcykiewicz, Bartlett, IL (US); Walter Joseph Olender, Shelby Township, MI (US); Joel Daniel Sandburg, Binghamton, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 10/747,953

(22) Filed: Dec. 31, 2003

(65) Prior Publication Data

US 2005/0142930 A1 Jun. 30, 2005

(51) Int. Cl.[7] ..... H01R 25/00; H01R 11/30; F02D 1/06

(52) U.S. Cl. ..... 439/638; 439/34; 439/347; 439/271; 239/5; 239/585.1

(58) Field of Search ..... 439/638, 651, 439/347, 34, 272, 271, 342, 385; 417/313, 417/422, 556; 239/5, 585.1, 585.4

(56) References Cited

U.S. PATENT DOCUMENTS

| | | | | |
|---|---|---|---|---|
| 4,280,661 A | | 7/1981 | Tanasawa et al. | 239/409 |
| 4,364,624 A | * | 12/1982 | Williams | 439/651 |
| 4,428,309 A | | 1/1984 | Chang | 110/262 |
| 5,306,156 A | * | 4/1994 | Gibbs et al. | 439/34 |
| 5,427,319 A | | 6/1995 | Bata | 239/585.4 |
| 5,465,911 A | | 11/1995 | Hall | 239/585.4 |
| 5,609,304 A | | 3/1997 | Sasao | 239/585.4 |
| 5,669,763 A | * | 9/1997 | Pryce et al. | 417/313 |
| 5,785,022 A | | 7/1998 | Haboush, II et al. | 123/456 |
| 5,967,423 A | | 10/1999 | Sumida et al. | 239/533.12 |
| 6,264,112 B1 | | 7/2001 | Landschoot et al. | 239/5 |
| 6,328,321 B1 | | 12/2001 | Nolan | 280/86.754 |
| 6,405,947 B2 | | 6/2002 | Fochtman | 239/585.4 |
| 6,422,488 B1 | | 7/2002 | Fochtman et al. | 239/585.5 |
| 6,457,988 B1 | * | 10/2002 | Andersen | 439/373 |
| 2001/0010341 A1 | | 8/2001 | Koizumi et al. | 239/468 |

* cited by examiner

*Primary Examiner*—Hien Vu
(74) *Attorney, Agent, or Firm*—Blank Rome LLP

(57) ABSTRACT

The present invention is directed to an electrical connector that attaches a fuel injector assembly to a vehicle control assembly. The electrical connector comprises a plastic molded body having two integrally formed portions, a base portion and a stem portion, and an electrical contact extending through the body from the stem portion to the base portion. The base is inserted into the fuel injector assembly with the electrical contact engaging a corresponding contact within the fuel injector assembly. Similarly, the electrical contact in the stem portion of the connector is attached to a corresponding contact of a control assembly, which provides the electrical signals to operate the fuel injector. The base portion includes a metallic sleeve that extends between its sidewalls and cooperates with a locking pin that is inserted through openings in the fuel injector assembly to lock the two components together. The sleeve openings are slightly offset from the fuel injector assembly openings so that when the locking pin is inserted, it aligns the two components and urges the electrical connector further into the fuel injector assembly. Additionally, the sides of the connector include deformable "crush pads" that when inserted into the fuel injector assembly are reshaped to provide a "snug" fit between the electrical connector and the fuel injector assembly.

13 Claims, 5 Drawing Sheets

FIG. 1
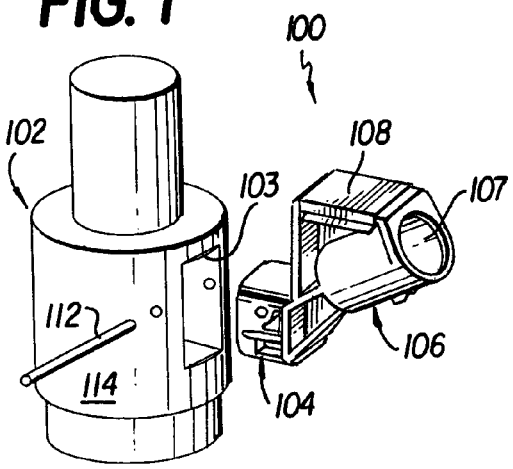
FIG. 2
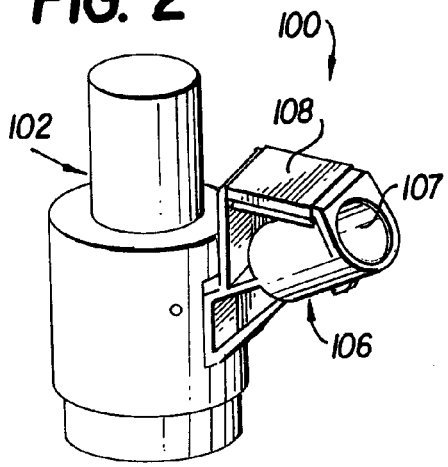
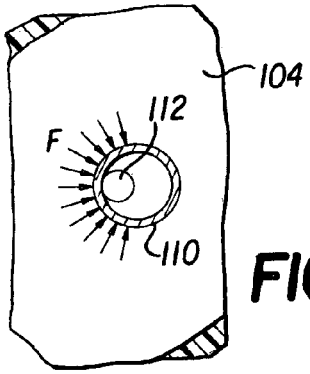
FIG. 5A
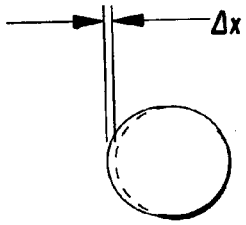
FIG. 5B
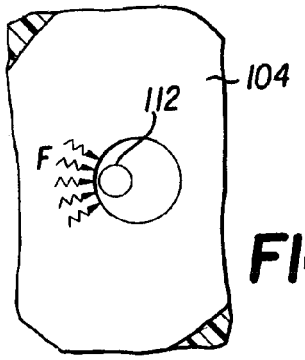
FIG. 5C
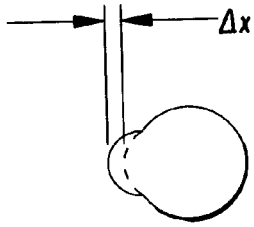
FIG. 5D

FUEL INJECTOR CONNECTOR

FIELD OF INVENTION

The present invention is directed to an electrical connector that attaches a fuel injector assembly to a control assembly. The control assembly sends electrical signals that control the timing of the fuel injectors to the fuel injector assembly via the electrical connector, which is provided with several features that improve the attachment between the electrical connector and the fuel injector assembly.

BACKGROUND OF THE INVENTION

Internal combustion vehicle engines have typically used carburetors to control their fuel-air mixture. A carburetor performs this task by drawing in liquid fuel from a fuel reservoir, vaporizing the liquid fuel, and then mixing it with a stream of air. More recently, carburetors have been replaced with more efficient electronic fuel injectors that pump vaporized fuel into an air stream in a timed or metered fashion. Because of their increased efficiency and performance, electronic fuel injectors have largely replaced carburetors in most vehicles today.

The timing of the operation of the fuel injector is regulated by a control assembly that sends electrical signals via an electrical connector. However, due to the electrical connector's close proximity to the engine pistons, it is subjected to particularly severe vibrations and is prone to becoming disconnected from the fuel injector assembly. The vibrations cause the electrical connector to suffer degraded performance by allowing contact phenomena, such as fretting or jitter, to establish themselves between the contacts of the electrical connector and the fuel injector. When the connection between the electrical connector and the fuel injector is not sufficiently secure, these problem are often exaggerated because any movement or "wiggle" between the two components worsen over time until the two components become disconnected.

Therefore, it would be advantageous to provide a electrical connector that is securely attached to a fuel injector assembly to provide a stable electrical connection between the control assembly and the fuel injector assembly. It would also be advantageous to provide an electrical connector that is resistant to shaking and vibration so as not to interfere with the electrical connection between the control assembly and fuel injector assembly.

SUMMARY OF INVENTION

The present invention is directed to an electrical connector that is attached to a fuel injector assembly and dampens vibrations between the electrical connector add fuel injector assembly. The electrical connector is comprised of a plastic molded body having two integrally formed portions, a base portion and a stem portion, and one or more electrical contacts extending through the body from the base portion to the stem portion. The base is inserted into the fuel injector and electrically connected thereto, while the stem portion of the connector is electrically attached to a control assembly.

The base portion of the electrical connector includes several features that improve the attachment between the electrical connector and the fuel injector assembly. The base portion includes a metallic sleeve with openings on both ends that partially align with corresponding openings in the fuel injector, and is secured by inserting a locking pin through the sleeve and fuel injector openings. The sleeve openings are slightly offset from the fuel injector assembly openings so that when the locking pin is inserted, the electrical connector is forced into the fuel injector assembly.

As a result of the locking pin forcing the electrical connector into the fuel injector assembly, the locking pin becomes slightly curved. This has the favorable effect of converting some of the shear forces, which act perpendicular to the locking pin, into less damaging tensile forces which act along its longitudinal axis.

The sleeve also has enlarged tapered ends that move the contact point between the sleeve and the locking pin into the interior of the base portion, where the shear forces acting on the locking pin and sleeve are less likely to fail. The tapered ends also have the added advantage of making it easier to insert the locking pin into the sleeve.

Additionally, the sides of the electrical connector include deformable "crush pads" that when inserted into the fuel injector assembly are reshaped to provide a "snug" fit between the electrical connector and the fuel injector assembly.

In addition to the above features, the stem portion of the electrical connector includes a flat top portion that serves as a identification platform, allowing manufacturing identification to be placed onto the electrical connector and easily viewed. Also, the base portion of the electrical connector includes an O-ring seal around the electrical terminals, providing a seal to prevent any fuel from entering the electrical connector.

BRIEF DESCRIPTION OF THE DRAWINGS

FIG. 1 shows a perspective view of an electrical connector prior to its insertion into a fuel injector assembly;

FIG. 2 shows a perspective view of the electrical connector after its insertion into the fuel injector assembly;

FIGS. 5A and 5B show a detailed side view of a locking pin and sleeve;

FIGS. 5C and 5D shows a detailed side view of the locking pin without a sleeve;

DETAILED DESCRIPTION OF THE PREFERRED EMBODIMENTS

Figure 3:
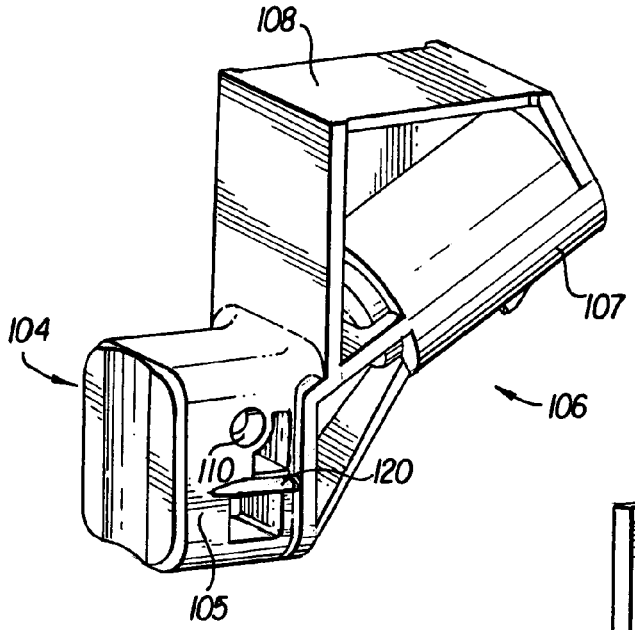
FIGS. 3 and 4 show side perspective views of the electrical connector.

A detailed description of the invention is now given with reference to FIGS. 1–9. FIGS. 1 and 2 show an electrical connector 100 just prior to and after insertion into "a fuel injector assembly 102, respectively. The electrical connector 100 is made from a high strength, corrosion resistant polymer body comprised of two integral portions, a base portion 104 and a stem portion 106.

The base portion 104 is a generally cube-shaped structure that is inserted into a connector cavity 103 in the fuel injector assembly 102. The connector cavity 103 is shaped to generally match the shape and size of the base portion 104 to provide a relatively tight or "snug" fit. The stem portion 106 extends out from the base portion 104 and includes a barrel 107 and an identification platform 108.

Figure 4:
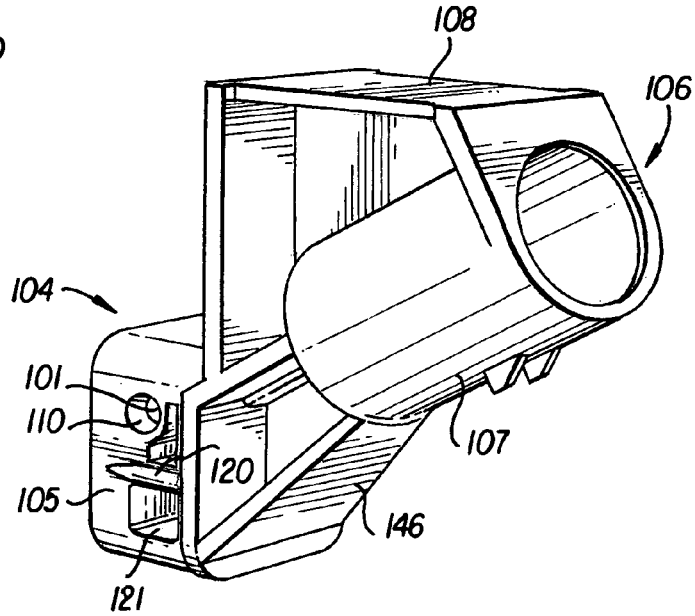
Figure 5:
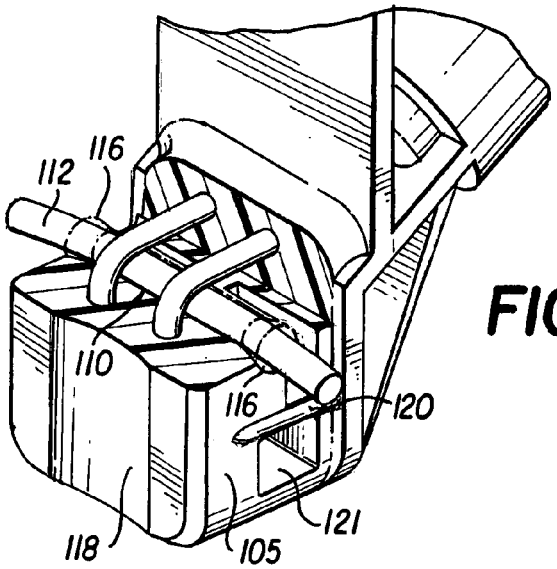
FIG. 5 shows a cut-away view of a base portion of the electrical connector.

FIGS. 3–5 show the electrical connector 100 in greater detail, with FIG. 5 showing a cut-away view of the base portion 104. These figures illustrate several features incorporated into the base 104 that ensure a tight and stable attachment between the electrical connector 100 and the fuel injector assembly 102. With reference to FIG. 5, the base 104 includes an insert molded metallic sleeve 110 located in a generally cylindrical cavity 101 in the interior body of the base 104, the sleeve 110 extending between the base's sidewalls 105. The ends of the sleeve 110 have tapered openings 116 that lie flush with the sidewalls 105, as shown in FIGS. 3 and 4. The sleeve 110 is preferably made from a high strength metal material, such as steel, but it is contemplated that any material may be used for the sleeve.

To secure the electrical connector 100 to the fuel injector assembly 102, the electrical connector 100 is inserted into the connector cavity 103 and secured by a locking pin 112 which is inserted through openings 114 in the fuel injector assembly and into the sleeve 110.

The sleeve 110 disperses the forces applied by the locking pin 112 over a broader area within the base 104, to reduce material creepage. This effect can be seen in FIGS. 5A–5D. FIG. 5A shows a side view of the base 104 and the sleeve 110 therein. The locking pin 112 abuts against the sleeve 110 which disperses the shear forces F on the base 104 around a large portion of its circumference. Over time, the shear forces F deform the base 104 as shown in FIG. 5B by an amount $\Delta X_1$ (i.e. creep). FIGS. 5C and 5D show the effect of the locking pin 112 on a base 104 not having a sleeve 110. FIG. 5C shows that the shear forces F are concentrated in a much smaller area, and FIG. 5D shows the amount of deformation $\Delta X_2$ in the base 104 is much larger and more exaggerated. Using the sleeve 110 of the present invention decreases the amount of deformation such that $\Delta X_1$ will always be less than $\Delta X_2$.

When the base 104 is inserted into the fuel injector assembly 102, the sleeve openings 116 are at first offset from the fuel injector openings 114. Upon insertion of the locking pin 112, the openings 114 and 116 are forced to align which causes the base portion 104 to move toward the bottom and back of the connector cavity 103. This produces a tight and secure attachment between the electrical connector 100 and the fuel injector assembly 102 by maintaining the base portion 104 under a force applied by the locking pin 112, thereby eliminating any "wiggle" between the two. It should be noted that although the locking pin 112 moves to align the openings 114 and 116 of the electrical connector 100 and the fuel injector assembly 102, the two sets of openings 114 and 116 never completely align. This is to maintain a continual force acting on the locking pin 112 and prevent a relaxed state where the electrical connector 100 may "rock" within the fuel injector assembly 102.

Furthermore, the sleeve openings 116 are tapered, having an outer face with a diameter larger than that of the locking pin 112 and tapering inwardly to an inner face having a diameter that closely matches the locking pin 112. The tapering produces an inner face that lies within the body of the base portion 104. This tapered feature provides several advantages, one of which is that the large diameter of the sleeve's outer face makes insertion of the locking pin 112 into the sleeve 110 much easier, especially considering that the sleeve openings 116 are offset from the fuel injector assembly openings 114.

Also, the principal forces acting at the connection between the sleeve 110 and locking pin 112 are shear forces. By using the tapered openings, the shear forces acting on the outer face of the sleeve openings 116 are moved into the interior of the body of the base 104 to the inner face of the sleeve opening 116, this being the contact point between the locking pin 112 and the sleeve 110. This is advantageous because the sidewalls 105 of the base portion are the locations that are most susceptible to cracking or failure due to shear forces. By moving the contact point between the locking pin 112 and the sleeve 110 inward, those shear forces are moved inside of the base 104 where failure is less likely to occur.

Additionally, because the sleeve openings 116 are offset from the fuel injector openings 114, the insertion of the locking pin 112 into the sleeve 110 causes the locking pin 112 to curve slightly, as best shown in FIG. 5. The curve is produced by the reactive forces generated in the locking pin 112 by the offset openings 114 and 116, and the force necessary to align the openings 114 and 116 (although the holes are never completely aligned). The slight curve has the desired effect of further reducing the shear forces acting on the locking pin 112. This is because the locking pin 112 is placed in the entry/exit direction of the fuel injector cavity 103, and the forces acting on the locking pin 112 are perpendicular to the entry/exit direction. Therefore, with a perfectly straight locking pin 112, all the forces acting on the locking pin 112 are shear forces perpendicular to the entry/exit direction. However, by providing a curved locking pin 112, some of the perpendicular shear forces are transferred to act along the length of the locking pin 112 in tension. Therefore, some of the shear forces are converted to tensile forces, and because the locking pin 112 is stronger in tension than in shear, the curved locking pin 112 is less likely to fail.

Figure 6:
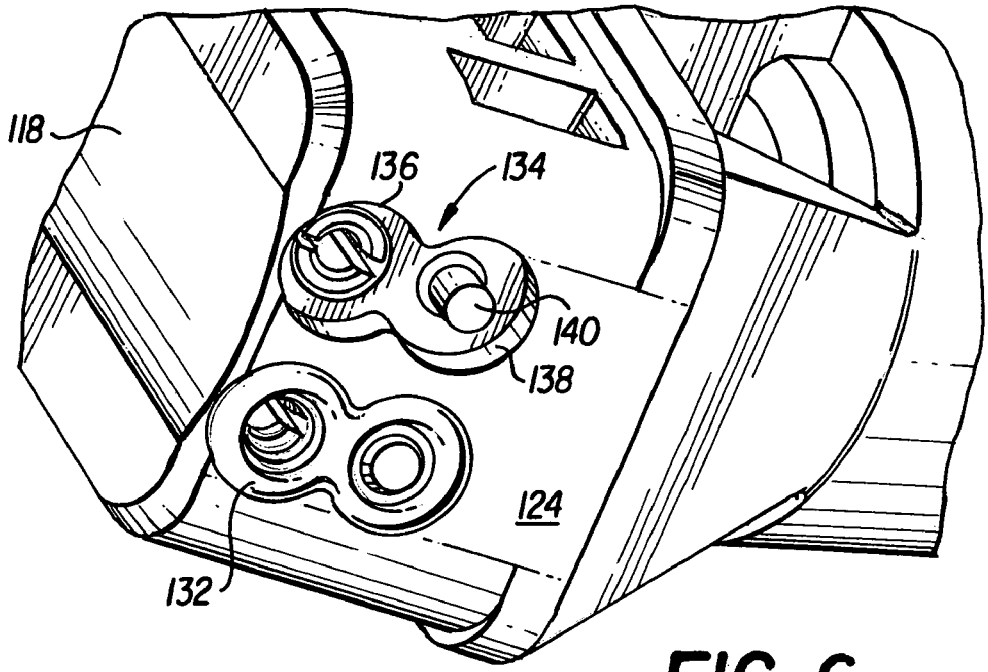
FIG. 6 shows perspective view of the front and bottom of the base of the electrical connector.
Figure 8:
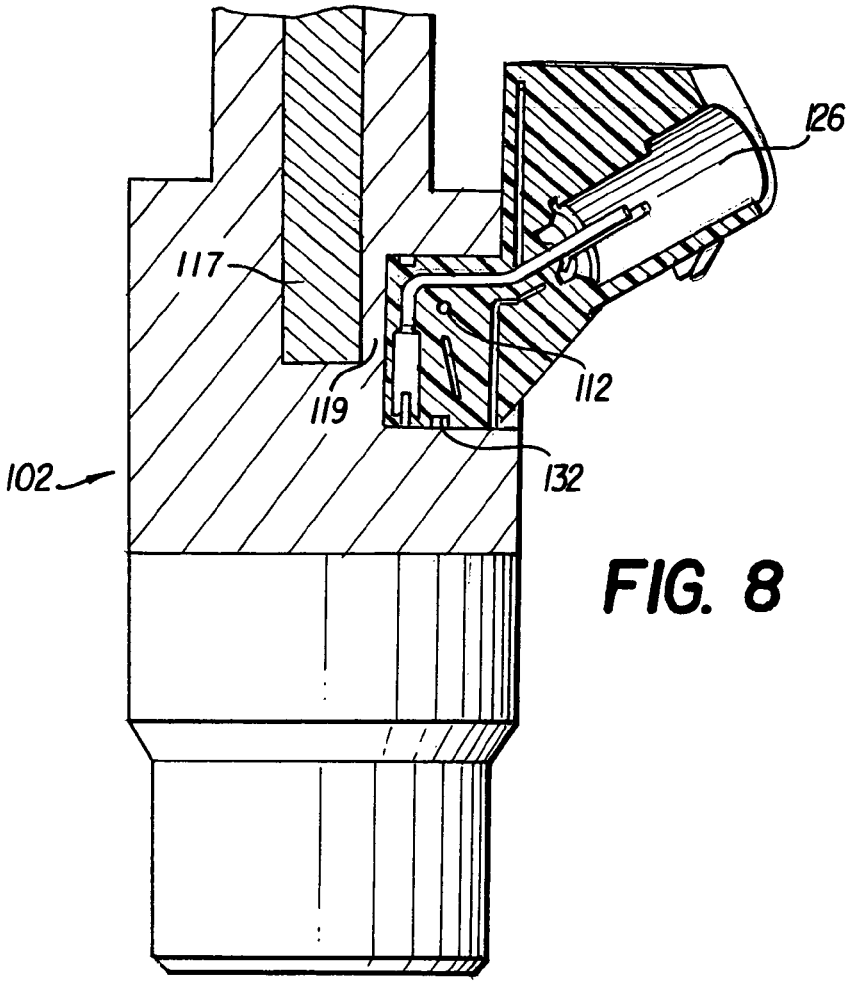
FIG. 8 shows a cross-sectional view of the electrical connector and fuel injector assembly.

The base portion 104 also has an inwardly curved front wall 118, as best shown in FIGS. 5 and 6. The curved front wall 118 provides a gap between the base 104 and an opposing wall 119 of the fuel injector assembly 102 when the electrical connector 100 is inserted therein. FIG. 8 shows the electrical connector 100 inserted into the fuel injector assembly 102. In a typical fuel injector assembly, a high pressure cavity 117 is located adjacent to the electrical connector cavity 103 and separated by the wall 119. As the fuel pressure is built up and released in the high pressure cavity 117, the wall 119 separating the two cavities flexes outward into the electrical connector cavity 103. The gap created by the curved front wall 118 compensates for the wall flexure and minimizes or eliminates the electrical connector's 100 movement caused by the expansion and contraction of the separating wall 119.

FIGS. 3–5 show the side walls 105 of the base 104 having crush pads 120 that extend outwardly from the base 104. The crush pads 120 are integrally formed with the base and are preferably made from the same material. The electrical connector cavity 103 is generally the same shape and size as the base 104 of the electrical connector, so that as the base 104 is inserted into the electrical connector cavity 103, the crush pads 120 are deformed to fit within the electrical connector cavity 103. The deformed crush pads 120 then provide a "snug" or interference fit within the electrical connector cavity 103, preventing movement or wiggle between the electrical connector 100 and the fuel injector assembly 102. It should be understood that the crush pads may be any shape and made from any material that is able to resiliently deform and provide the frictional engagement between the base 104 and the connector cavity 103.

Above and below the crush pad 120 are a core-outs 121, which are simply hollowed out portions of the base 104. The core-outs 121 reduce the amount of material necessary to form the base 104, and consequently, lowers the manufacturing cost of the electrical connector 100.

Figure 7:
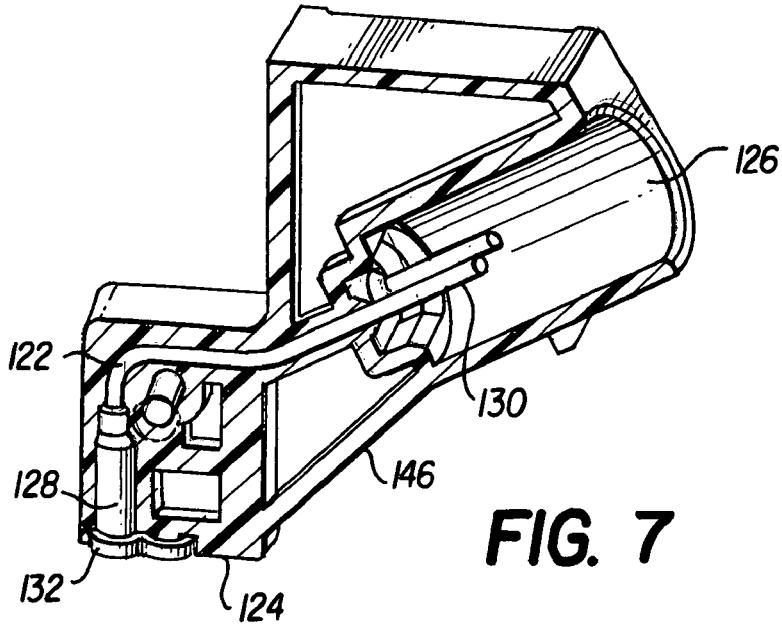
FIG. 7 shows a cross-sectional view of the side of the electrical connector.

FIGS. 7 and 8 show cut-away views of the electrical connector 100, alone and connected to the fuel injector assembly 102, respectively. As shown in the figures, a pair of electrical contacts 122 are provided within the electrical connector 100 and are run from a bottom surface 124 of the base 104 to a barrel portion 126 of the stem 106. Each contact 122 is preferably made from a single nickel-silver alloy that does not require additional finishing and whose oxides are less electrically restrictive. Although a nickel-silver alloy is preferred, any other material that can carry an electrical signal may be used with the invention.

The portion of the electrical contacts 122 in the base 104 are formed as female sockets 128 into which corresponding male pins of the fuel injector assembly 102 are inserted. The portion of the electrical contacts 122 in the barrel 126 are formed as male pins 130, so that a mating electrical harness (not shown) of a control assembly may be inserted into the barrel 126 and attached thereto. Although the electrical contact 122 has been described as having male 130 and female 128 ends, it should be understood that the type of connections used with the electrical contact 122 may be altered without departing from the scope of the invention.

Seals 132 are attached to the bottom surface 124 of the base 104 around the female socket 128 to prevent fuel from entering the electrical connector 100, as" best shown in FIG. 6. The bottom surface of the base 124 includes two cavities 134 shaped like a figure eight ("8"). A first socket portion 136 of the cavity 134 contains the female socket 128 for the electrical connector 122. A second socket portion 138 of the cavity 134 includes a pin 140 to help retain the seal 132. The seal 132 is resiliently placed into the cavity 134 and is held in place due to the frictional engagement of the seal 132 with the wall of the cavity 134, with the pin 140 providing further frictional engagement. When in place, a portion of the seal 132 protrudes out of the cavity 134 and contacts an opposing surface of the fuel injector assembly to provide the seal between the two components. Although the figures show a figure eight (8) seal 132, the seal 132 may be made from a single O-shaped seal in the first socket portion 136 of the cavity or any other suitable configuration.

Figure 9:
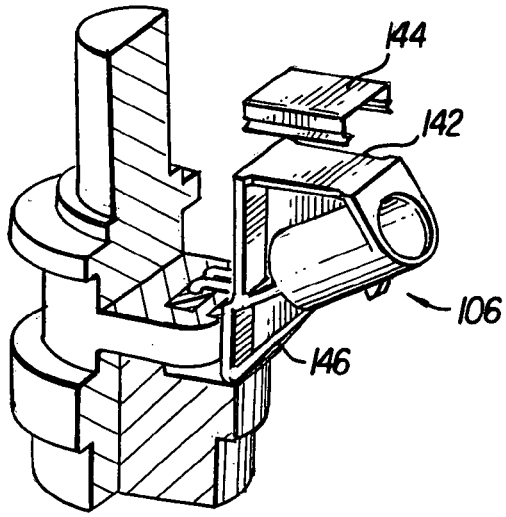
FIG. 9 shows the electrical connector prior to the attachment of an identification plate.

FIG. 9 shows additional features of the present invention. The stem 106 of the electrical connector includes a flat top platform 142. Product identification can be placed onto the platform 142 either directly, by laser etching or ink marking, or by using an identification plate 144 which is placed onto the platform 142. This allows important information to be placed onto the electrical connector 100 in a location that is easily viewed. Also, a support bracket 146 is provided between the base 104 and the stem 106, providing added rigidity and strength to the electrical connector 100.

Figure 10:
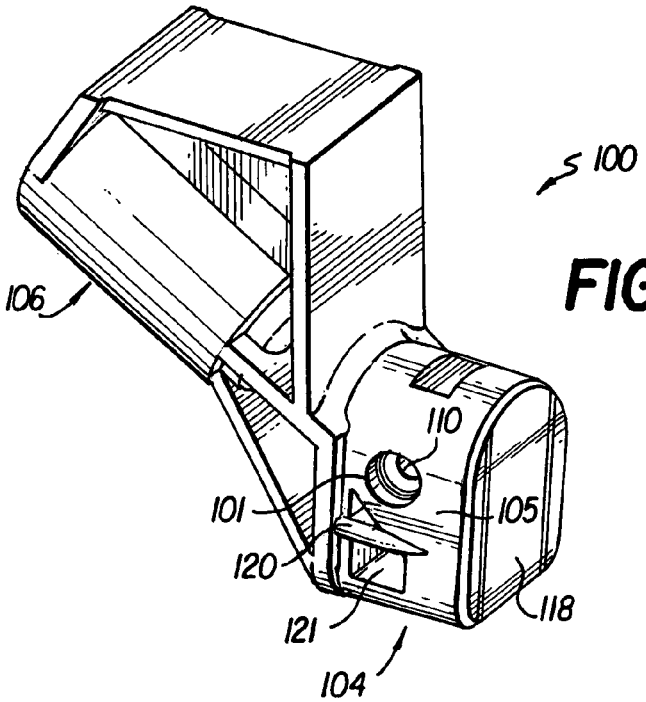
FIGS. 10–12 show a second embodiment of the electrical connector.
Figure 11:
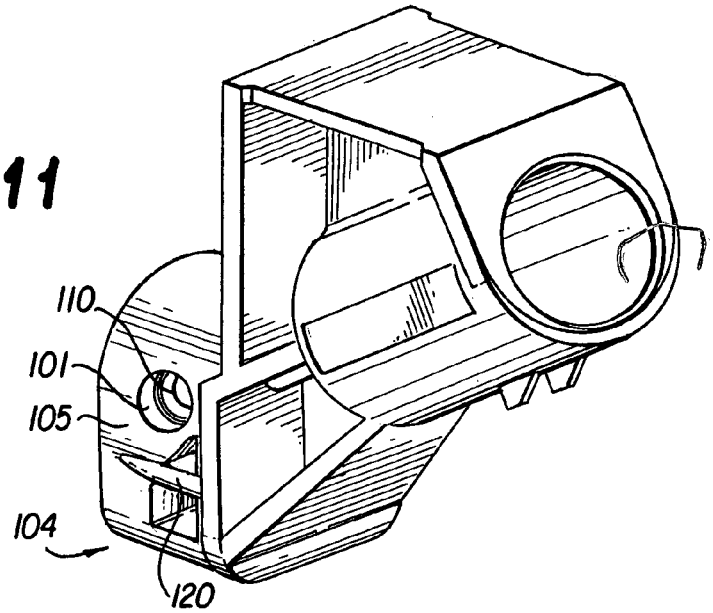
Figure 12:
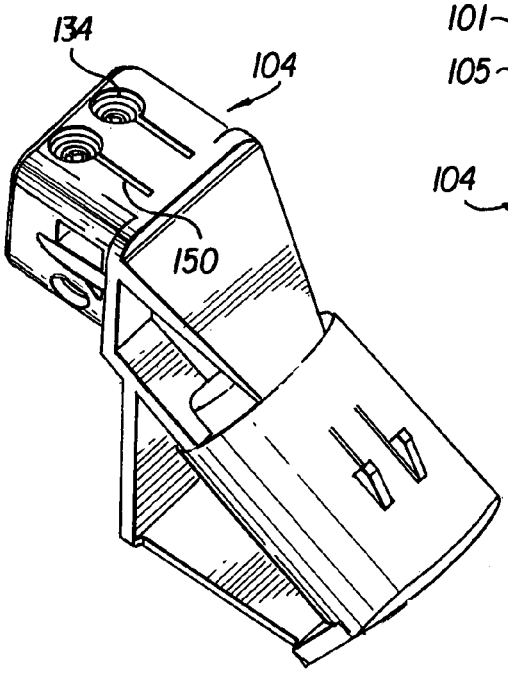

FIGS. 10–12 show a second embodiment of the electrical connector 100. Here, the shape of the base 104 has been changed, with its top portion having a rounded contour, so that the base 104 now has an "igloo" shape. This shape reduces the amount of time required to machine the electrical connector, thus reducing its manufacturing cost.

Additionally, the sleeve 110 is recessed within the cavity 101, so that its ends are no longer flush with the base's sidewalls 105. This reduces the stress on the outer surface of the base, particularly along the top contoured portion, where cracking or other failure is more likely to occur. The potential for failure at the surface is reduced by moving the contact point of the sleeve 110 with the base portion 104 into the interior of the body of the base portion 104, where its ability to support stress is greater. This phenomenon is explained above with respect to the first embodiment of the electrical connector having a sleeve 110 with tapered ends. It should be understood that the second embodiment of the sleeve 110 also includes tapered ends, but that because the sleeve 110 is already recessed into the interior the base portion body 104, the tapered ends are not required.

FIG. 12 shows the bottom surface of the base portion 104 which seals the base portion 104 of the electrical connector 100. Here, the cavities 134 are round or "O"-shaped, rather than the figure "8" shape of the first embodiment, and hold similarly shaped round seals (not shown). A vent 150 is provided with each cavity 134 to relieve excessive pressure.

Lastly, it should be understood that except for the specific features mentioned above, the second embodiment of the invention is substantially similar or identical to the first embodiment of the invention.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. An electrical connector for a fuel injector assembly comprising:

a base portion, a stem portion and at least one electrical contact extending from the base portion to the stem portion; and said base portion having a front wall, a bottom wall, two side walls, and a sleeve extending between the side walls of said base portion and cooperating with a locking pin to secure the electrical connector to a fuel injector assembly wherein the at least one electrical contact is located on the bottom surface of said base portion to engage a corresponding contact in the fuel injector assembly, the bottom surface including a sealing member placed in a cavity around the electrical contact to seal the electrical contact.

2. The electrical connector of claim 1, wherein said base portion and said stem portion are integrally formed from a single polymer mold.

3. The electrical connector of claim 1, wherein said base portion including deformable crush pads that deform as said base portion is inserted into a connector cavity in a fuel injector assembly to provide a tight fit between the electrical connector and the fuel injector assembly.

4. The electrical connector of claim 1, wherein the sleeve has tapered ends such that an outer face of the tapered end is flush with the sidewall of said base portion and an inner face of the tapered end lies within said base portion; and the outer face of the tapered end has a larger diameter than the inner face of the tapered end, and the inner face of the tapered end has a diameter slightly larger than the diameter of the locking pin so that the locking pin may bend within the sleeve.

5. The electrical connector of claim 1, wherein the ends of the sleeve are recessed within the body of the base portion.

6. The electrical connector of claim 1, wherein the sleeve of said base portion has sleeve openings that are offset from corresponding openings in a connector cavity of the fuel injector assembly, and insertion of the locking pin into the sleeve openings and the connector cavity openings urges the base portion into the connector cavity.

7. The electrical connector of claim 1, wherein the locking pin is adapted to be inserted into the sleeve to secure the electrical connector to a fuel injector assembly and insertion of the locking pin into the sleeve induces a curve in the locking pin.

8. The electrical connector of claim 1, wherein the front wall of said base portion is concave to accommodate an expansion of an adjacent wall of the connector cavity and prevent said base portion from moving upon said expansion.

9. The electrical connector of claim 1, wherein said stem portion includes a flat identification platform for placing indicia on the electrical connector.

10. An electrical connector for a fuel injector assembly comprising:

a base portion, a stem portion and at least one electrical contact extending from the base portion to the stem portion;

said base portion having a front wall, a bottom wall and two side walls; and said base portion including deformable crush pads that deform as said base portion is inserted into a connector cavity in a fuel injector assembly to provide a tight fit between the electrical connector and the fuel injector assembly wherein the at least one electrical contact is located on the bottom surface of said base portion to engage a corresponding contact in the fuel injector assembly, the bottom surface including a sealing member placed in a cavity around the electrical contact to seal the electrical contact.

11. The electrical connector of claim 10, wherein said base portion and said stem portion are integrally formed from a single polymer mold.

12. The electrical connector of claim 10, wherein the front wall of the base portion is concave.

13. The electrical connector of claim 10, wherein said stem portion includes a flat identification platform for placing indicia on the electrical connector.

* * * * *

UNITED STATES PATENT AND TRADEMARK OFFICE

CERTIFICATE OF CORRECTION

PATENT NO. : 6,939,178 B2
DATED : September 6, 2005
INVENTOR(S) : Robert Raymond Arcykiewicz et al.

It is certified that error appears in the above-identified patent and that said Letters Patent is hereby corrected as shown below:

Column 1,
Line 36, change “problem” to -- problems --;
Line 53, change “add” to -- and --.

Column 2,
Line 23, change “a identification” to -- an identification --.

Column 5,
Lines 19 and 21, change “male pins” to -- male plugs --;
Line 30, change “as” best shown” to -- as best shown --.

Column 6,
Line 39, after “assembly” insert a semi-colon -- ; --.

Column 8,
Line 5, after “assembly” insert a semi-colon -- ; --.

Signed and Sealed this

Ninth Day of May, 2006

JON W. DUDAS
*Director of the United States Patent and Trademark Office*